US011566454B2

(12) United States Patent
Scholz et al.

(10) Patent No.: US 11,566,454 B2
(45) Date of Patent: Jan. 31, 2023

(54) MOTOR VEHICLE LOCK

(71) Applicant: Kiekert AG, Heiligenhaus (DE)

(72) Inventors: Michael Scholz, Essen (DE); Holger Schiffer, Meerbusch (DE); Cyrille Roussel, Mettmann (DE)

(73) Assignee: Kiekert AG, Heiligenhaus (DE)

( * ) Notice: Subject to any disclaimer, the term of this patent is extended or adjusted under 35 U.S.C. 154(b) by 148 days.

(21) Appl. No.: 17/043,252

(22) PCT Filed: Apr. 5, 2019

(86) PCT No.: PCT/DE2019/100312
§ 371 (c)(1),
(2) Date: Sep. 29, 2020

(87) PCT Pub. No.: WO2019/206362
PCT Pub. Date: Oct. 31, 2019

(65) Prior Publication Data

US 2021/0025201 A1 Jan. 28, 2021

(30) Foreign Application Priority Data

Apr. 25, 2018 (DE) ..... 10 2018 109 899.5

(51) Int. Cl.
*E05B 81/42* (2014.01)
*E05B 81/06* (2014.01)
(Continued)

(52) U.S. Cl.
CPC ..... *E05B 81/42* (2013.01); *E05B 81/06* (2013.01); *E05B 81/16* (2013.01); *E05B 81/34* (2013.01); *E05B 83/36* (2013.01)

(58) Field of Classification Search
CPC ..... E05B 81/04; E05B 81/06; E05B 81/14; E05B 81/16; E05B 81/18; E05B 81/30;
(Continued)

(56) References Cited

U.S. PATENT DOCUMENTS 6,279,361 B1 * 8/2001 Baukholt ..... E05B 81/14 292/201
2010/0320777 A1 * 12/2010 Jankowski ..... E05B 77/42 292/200

(Continued)

FOREIGN PATENT DOCUMENTS

DE 848588 C * 6/1949
DE 19943483 B4 3/2008

(Continued)

OTHER PUBLICATIONS

DE 848588 C as NPL document (Year: 1952).*
Translation of International Search Report dated Aug. 1, 2019, for PCT/DE2019/100312.

*Primary Examiner* — Christine M Mills
*Assistant Examiner* — Christopher F Callahan
(74) *Attorney, Agent, or Firm* — Renner, Otto, Boisselle & Sklar, LLP

(57) ABSTRACT

A motor vehicle lock, more particularly for a vehicle rear door, having a lock cover and a locking mechanism consisting of substantially rotary latches and at least one pawl, furthermore having at least one coupling lever, and at least one electric drive, wherein the coupling lever can take up different positions and interacts with a drive element of the drive and a central locking mechanism, wherein, to take up its positions, the coupling lever is connected to the drive element. The drive element and/or lock cover have/has a latching contour having at least two position holders wherein at least one position holder is designed asymmetrically and a spring mechanism is provided, wherein the spring mechanism cooperates with the latching contour, as a result of which the coupling lever can be positioned in the different positions.

20 Claims, 5 Drawing Sheets

(51) Int. Cl.
*E05B 81/16* (2014.01)
*E05B 81/34* (2014.01)
*E05B 83/36* (2014.01)

(58) Field of Classification Search
CPC ..... E05B 81/34; E05B 81/36; E05B 81/42; E05B 2015/0493; Y10T 292/1047; Y10T 292/1082; Y10T 292/1079; Y10S 292/23
See application file for complete search history.

(56) References Cited

U.S. PATENT DOCUMENTS

| | | | | |
|---|---|---|---|---|
| 2012/0193926 | A1* | 8/2012 | Watanabe | E05B 81/66 292/195 |
| 2015/0204118 | A1* | 7/2015 | Cetnar | E05B 77/30 292/199 |
| 2017/0314298 | A1* | 11/2017 | Tomaszewski | E05B 77/30 |

FOREIGN PATENT DOCUMENTS

| | | | |
|---|---|---|---|
| DE | 102007055413 | A1 | 5/2009 |
| DE | 102008011545 | A1 | 9/2009 |
| DE | 202014103113 | U1 | 10/2015 |
| DE | 102015113122 | A1 | 2/2017 |
| EP | 2930584 | A1 | 10/2015 |

* cited by examiner

MOTOR VEHICLE LOCK

FIELD OF DISCLOSURE

The present invention relates to the field of motor vehicle latching systems and relates to a motor vehicle latch. A motor vehicle latch includes a latch cover and a locking mechanism consisting substantially of a catch and at least one pawl, and furthermore comprises at least one coupling lever and at least one electrical drive, the coupling lever being able to assume various positions and the coupling lever interacting with a drive element of the drive and with a central locking mechanism, the coupling lever being connected to the drive element in order to assume the position thereof.

BACKGROUND OF DISCLOSURE

A motor vehicle latch of the type described at the outset is typically attached to a motor vehicle door and interacts with a locking pin on the bodywork side. Furthermore, however, the arrangement can also be reversed, such that the locking pin is arranged on the motor vehicle door and the latch is arranged on the bodywork side.

Motor vehicle latches of this kind are equipped with a central locking mechanism and typically have different positions and functions associated therewith. In this case, it is conceivable that the positions of the coupling lever can be adjusted by means of the drive. Motor vehicle latches of this kind are known for example from DE 199 43483B4. In this case, both an anti-theft module and a locking module are achieved. It is furthermore possible to lift the pawl over the anti-theft module directly, or optionally with interposition of a tripping lever.

However, a disadvantage of the motor vehicle latches known from the state of the art is that, when lifting the anti-theft module by means of the coupling lever, there is a risk of incorrect operation of the anti-theft lock or of the central locking system. This results in a faulty interaction chain in the latch, as a result of which users may become locked in or out of the vehicle.

There is therefore a need to develop motor vehicle latches such that the risk of incorrect operation within the interaction chain can be reduced or even prevented.

SUMMARY OF DISCLOSURE

The technical problem addressed by the present invention is therefore that of overcoming the disadvantages known from the state of the art, at least in part. In particular, the problem addressed by the present invention is that of providing a motor vehicle latch in a cost-effective and structurally advantageous manner, in which latch the correct positioning of the coupling lever can be ensured.

The above problem is solved by a motor vehicle latch having the features of the present disclosure.

Further features, details, advantageous developments, and improvements of the invention can be found in the description and the drawings. In this case, the features described the description and the drawings can be combined or varied in any technologically logical manner, and reveal further embodiments of the invention. It is noted that the exemplary embodiments described in the following for the purpose of explaining the invention are not limiting. In this case, features and details that are described in connection with the motor vehicle door latch according to the invention of course also apply in connection with the method according to the invention, and vice versa in each case, such that reciprocal reference always is or can be made with respect to the disclosure of the individual aspects of the invention.

According to the invention, the motor vehicle latch, in particular a motor vehicle latch for a motor vehicle rear door, comprises a latch cover and a locking mechanism, the locking mechanism substantially comprising a rotary latch and at least one pawl. The motor vehicle latch furthermore comprises at least one coupling lever and at least one electrical drive, the coupling lever being able to assume various positions and the coupling lever interacting with a drive element of the drive and with a central locking mechanism, the coupling lever being connected to the drive element in order to assume the position thereof. According to the invention, the drive element and/or the latch cover have a latching contour having at least two position receiving points, at least one position receiving point being asymmetrical, and a spring mechanism being provided, the spring mechanism cooperating with the latching contour such that the coupling lever can be positioned in the different positions.

The asymmetry now ensures that different positioning paths or travel ranges are available, as a result of which incorrect operation of the anti-theft lock or of the central locking system can be substantially prevented. In this case, it is conceivable that the positions of the coupling lever can be better defined by means of the different positioning paths.

The above-mentioned and further advantages result in particular from the asymmetrical position receiving point of the latching contour which cooperates with the spring mechanism. Within the context of the invention, asymmetrical is intended to be understood such that at least one position receiving point is designed in a geometrically different manner compared with at least one further position receiving point. Thus, at least the contact surface of the latching receptacle that cooperates with the spring mechanism is designed so as to be asymmetrical, as a result of which different positioning paths result. If the drive element is rotated about the axis of rotation thereof, the spring mechanism interacts with the latching contour, in particular the position receiving points, in that the spring mechanism is supported on the latching contour, in particular the position receiving point. As a result, the coupling lever connected to the drive element is displaced accordingly and interacts with the locking mechanism, in particular the central locking mechanism. It is thus possible for the corresponding positions to be set.

Within the context of the invention, the positions can also refer to functional positions. In this case, it is conceivable for a first position to be defined by the functional position "anti-theft lock engaged and central locking system engaged." A second position can be defined by the functional position "anti-theft lock disengaged and central locking system engaged." A possible third position can be defined by the functional position "anti-theft lock and central locking system disengaged." In the case of motor vehicle latches having an anti-theft function, the functional position or position "anti-theft lock" can also be designated "theft-proof," both the outside door handle and the inside door handle remaining in the functionless position in the theft-proof position. In this way, it is ensured that a motor vehicle door does not provide any access to the interior of the motor vehicle, even in the case of a smashed motor vehicle pane. Furthermore, in addition or alternatively to the anti-theft lock, a child safety lock may be provided, such that the functional position "anti-theft lock" can also be a "child safety lock" functional position.

The coupling lever according to the invention is preferably arranged on the drive element of the drive so as to be rotatable. According to the invention, it is now possible for the drive element to be designed so as to be rotatable about an axis, it being possible for the drive element to be rotated, by means of the drive, about the axis of rotation, into various positions. Accordingly, the coupling lever connected to the drive element is moved into the different positions. In this case, the drive element can be controlled mechanically and/or electrically into the different positions, the respective position changes taking place either purely mechanically or purely electrically.

According to the invention a motor vehicle latch can also comprise a latch case and a latch cover, in addition to a latch housing, by means of which latch cover the latch case can be closed. The locking mechanism is mounted in the latch case, which locking mechanism is composed of a catch and at least one pawl that cooperates therewith. The catch, and thus the motor vehicle door latch defined in this manner, interacts with the locking pin in a known manner.

As is conventional, the latch housing can be arranged on the bodywork side, or on the bonnet or door side. In the first case, the latch housing is mounted on a vehicle body, for example by screws. The variant mentioned second corresponds to the latch housing and, together therewith, the door latch, being attached in the inside or on a door, a bonnet, a flap or the like.

If a motor vehicle latch is mentioned, within the context of the invention, this covers such motor vehicle locks which can be used for example in side doors, sliding doors, flaps, bonnets and/or covers, at the place where pivotably or displaceably mounted components are arranged on the motor vehicle. It is also conceivable to arrange the motor vehicle lock in a backrest of a seat.

Advantageously, at least the second position receiving point has a geometry that differs from the first position receiving point. Accordingly, different positioning paths or travel ranges/adjustment angles can be achieved. In particular, the geometry of the second position receiving point is designed such that a greater lift is provided for the coupling lever. The lift results, inter alia, from the geometry of the latching contour in the region of the position receiving points and the spacing, formed thereby, from the pivot point of the drive element.

It is conceivable for the first position I to have an adjustment angle $\alpha$, the second position II to have an adjustment angle $\alpha+\gamma$, and the third position III to have an adjustment angle $\alpha+\beta$, in particular the third position III being able to be reached in a purely electrically driven manner. It is thus possible for the central locking system to be disengaged only by the electrical drive. It is thus possible for incorrect operation, in particular an incorrect operating sequence, to be substantially prevented. In this case, the adjustment angle $\alpha+\gamma$ of the second position and the adjustment angle $\alpha+\beta$ of the third position are preferably larger. Accordingly, a larger lift or leverage for adjusting the coupling lever can be achieved by the adjustment angles of the second and/or third position. It is thus also possible to refer to a larger/longer travel range for the coupling lever, which can be achieved by the increased angle.

It is advantageously possible for the adjustment angle $\alpha+\gamma$ of the second position to be formed in a region between a tipping point and an apex of the second position receiving point. The tipping point is formed between the first position receiving point and the second position receiving point. The tipping point is a position between the first and second position receiving point which is arranged on another plane compared with the apex of the first and/or second position receiving point. The tipping point is arranged between the two apexes of the first and second position receiving point, and thus further away from the axis of rotation of the drive element. The tipping point thus forms a maximum or highest point between the apexes of the two position receiving points. The anti-theft lock and/or child safety lock is preferably disengaged from or after overcoming the tipping point. The central locking system can still be engaged. Thus, after the tipping point has been overcome, the anti-theft lock and/or child safety lock can be disengaged accordingly, and the central locking system is still engaged. Only when the drive element is rotated further and the spring mechanism slides further in is the central locking system also disengaged.

The first position receiving point can preferably be of a length L1, and the at least second position receiving point can be of a length L2, the length L2 of the second position receiving point being greater than the length L1 of the first position receiving point. A greater length also means a greater leverage or with the spring mechanism, and thus a longer travel range or increased lift for the coupling lever. The length of the position receiving point thus also brings about a change or increase in the adjustment angle of the spring mechanism on the drive element. The adjustment angle of the spring mechanism at the second position receiving point is thus increased compared with the achievable adjustment angle of the first position receiving point.

It is furthermore conceivable for the position receiving points to be designed so as to be substantially semi-circular and/or substantially V-shaped. In particular, the position receiving points are designed as concave receptacles in the latching contour. The design of the position receiving points in the latching contour makes it possible to allow for secure positioning of the spring mechanism in the respective positions. The concave geometry allows for the spring mechanism to slide into the position receiving point, and to be moved out of the first or second receptacle only by corresponding action of force, for example of the drive. In the region of the apex of the position receiving point, the spring mechanism comes into abutment on the latching contour, as a result of which the positioning is fixed. In this case, the spring mechanism presses against the latching contour and holds the drive element in position.

Owing to the asymmetrical geometry, however, a larger adjustment path/positioning path is required for reaching the third position, such that it is possible to ensure that the anti-theft lock and/or anti-theft lock is disengaged before the central locking system.

Advantageously, in the first position receiving point the spring mechanism comprises a contact point, in each case, on a lay-on surface in each case, and in the second position said mechanism has a contact point with a contact surface. The two contact points of the spring mechanism at the first position receiving point allow for substantially clearance-free positioning of the spring mechanism, and accordingly defined force transfer of the spring to the drive element.

This achieves the advantage that the springs can be shaped, calculated and thus designed in a structurally simpler manner, and therefore the lever arm between the spring mechanism and the drive element can be defined by the definable lay-on surfaces and thus contact points of the spring mechanism with the position indentations. For this purpose, at least the first position indentation comprises at least one, preferably two, straight lay-on surfaces, on the coil portion of which the spring mechanism is in abutment. The outer portions of the preferably semi-circular position indentations are thus straight, and no longer curved. Accordingly, a combination of a semi-circular and V-shaped design of the position indentations results. If the position indentation is considered to be substantially U-shaped, the limbs no longer have any curve towards the outside. Instead, the limbs are straight towards the end.

The spring mechanism according to the invention can be designed primarily as a torsion spring, in particular a double torsion spring. In this case, a torsion spring allows for a cost-effective design of a motor vehicle latch, it being possible for sufficient spring force for the positioning of the drive element, and thus of the coupling lever, to be provided at the same time. In this case, the torsion spring, in particular the double torsion spring, allows for a direct force transfer to be exerted on the position indentations of the latching contour. For this purpose, the spring mechanism is preferably arranged on the latch housing or the latch case or latch cover, and interacts with the position indentations of the latching contour of the drive element or of the latch cover. In this case, in the case of a double torsion spring, the ends of the springs can preferably be mounted in the latch housing, the latch cover or the latch case. Accordingly, the spring can on the one hand be supported on the bearing points, and on the other hand act, with a spring force, on the latching contour of the drive element or of the latch cover.

Within the context of the invention, the spring mechanism, in particular the double torsion spring, can be arranged on the latch cover, on the coupling lever, or on the drive element, it being possible for a coil portion of the spring mechanism to be brought into contact at least with the position indentations of the latching contour for the purpose of fixing in position. Accordingly, the coil portion of the spring mechanism comprises at least one contact point for contact with the position indentations of the latching contour. As a result of the torsional spring force of the spring, the coil portion is always pressed on the latching contour or the position indentations of the latching contour on the drive element. In this case, the spring is preferably always pretensioned by the bearing points thereof, such that there is no angular play between the drive element and the spring mechanism. The torsion spring preferably comprises approximately one to approximately 15 coils, preferably between approximately 5 coils and approximately 10 coils. Furthermore, it may be advantageous for the spring mechanism to be a steel spring or a plastics spring.

The length of the first position receiving point is advantageously smaller than the diameter of the coil portion of the spring mechanism. This prevents the coil portion from being in abutment on the position receiving point and being able to transfer sufficient force, but at the same time release from the position receiving point by means of the drive is made possible. The coil portion thus does not rest in the position receiving point in an entirely form-fitting manner.

It is furthermore conceivable for the spring mechanism, in particular the double torsion spring, to comprise at least two fastening ends, each fastening end being arranged in one fastening receptacle, respectively, in particular in one slot, respectively. In this case, the fastening receptacle is preferably formed in the latch cover or the drive element. Thus, in the event of a deformation of a double torsion spring, the slot allows for the fastening ends of the double torsion spring to be able to move in the slot. Furthermore, the fastening of the fastening ends in the fastening receptacles, in particular in the slot, allows for a defined force transfer from the spring mechanism to the latching contour and thus the position indentations to be made possible. Clearance compensation can also be established by the fastening, in particular in at least one slot of a fastening end of the spring mechanism.

It is advantageously possible for the drive element to be designed as a worm gear and to comprise an external toothing portion which can be brought into engagement with the electrical drive. In particular, the external toothing portion can be brought into engagement with a worm gear of the electrical drive. Accordingly, the drive element is designed so as to have external toothing, and is rotatably arranged on the latch cover or latch housing by means of a bearing. The drive element designed as a worm gear preferably comprises a plastics material. The external toothing portion and the latching contour, in particular the position indentations, are preferably arranged on the drive element so as to be diametrically opposed to the external toothing portion. The design as a worm gear having an external toothing portion also makes it possible for installation space to be saved, and for a cost-effective motor vehicle latch to be provided. In particular if the external toothing portion and the latching contour are diametrically opposed to one another, a compact design can be achieved.

It is furthermore conceivable for the external toothing portion to be formed on the drive element, on the periphery, on a first plane, and for the latching contour to be formed on an at least second plane. This results in the advantage that the angle of rotation can be enlarged and more positions can be achieved. In this case, on different planes means that a plurality of planes or steps can be formed along the axis of rotation of the drive element.

Within the context of the invention, the coupling lever can be rotatably mounted on a bearing seat on the drive element. It is in particular conceivable for the bearing seat to be arranged on the rear of the latching contour. For example, the bearing seat can be formed as a bore on the drive element or on the coupling lever, the drive element and the coupling lever being interconnected by means of a bearing pin or a bolt.

According to the invention, it may be advantageous for two coupling levers to be provided, the first coupling lever being operatively connected to the second coupling lever by means of a transmission lever. In this case, the second coupling lever is designed as an external locking lever. In this case, the first or the second coupling lever, external locking lever, are connected to the central locking mechanism is a functionally operative manner. Accordingly, the central locking mechanism can be transferred into the different functional positions by means of a lever action. As a result, a movement of the first coupling lever towards the external locking lever can be made possible. The transmission lever is preferably movably mounted on the first coupling lever and/or external locking lever, by means of a ball head. By means of a carrier arm, the transmission lever can transfer a movement of the first coupling lever or of the external locking lever to the other lever in each case.

The drive element advantageously comprises a mechanical end stop, it being possible for the end stop to be brought into contact with a housing stop on the latch cover or a latch casing. The end stop ensures in particular that the drive element is not rotated further in the event of electrical/motorized displacement of the drive element. Accordingly, the end stop comes into contact with the mating stop, and the drive element cannot be twisted further in one direction. The end stop is preferably arranged on the drive element at a position which has the same angle as or a larger angle than the third adjustment angle. Upon or after reaching the third position, the end stop and the housing stop thus come into contact, and further movement of the drive element in this direction is not possible. In this case, the end stop is preferably arranged on the side of the drive element remote from the latching contour/position receiving points.

BRIEF DESCRIPTION OF DRAWINGS

Further features that improve the invention will become clear from the following description of some embodiments of the invention which are shown schematically in the figures. In this case, it should be noted that the figures are merely descriptive in character and are not intended to limit the invention in any way. Thus, embodiments are also to be considered covered and disclosed by the invention which are not explicitly shown or explained in the figures, but are clear from and can be achieved by separated combinations of features from the embodiments explained. In the figures, the same reference signs denote the same or functionally similar components, unless otherwise specified.

In the figures.

DETAILED DESCRIPTION

Figure 1A:
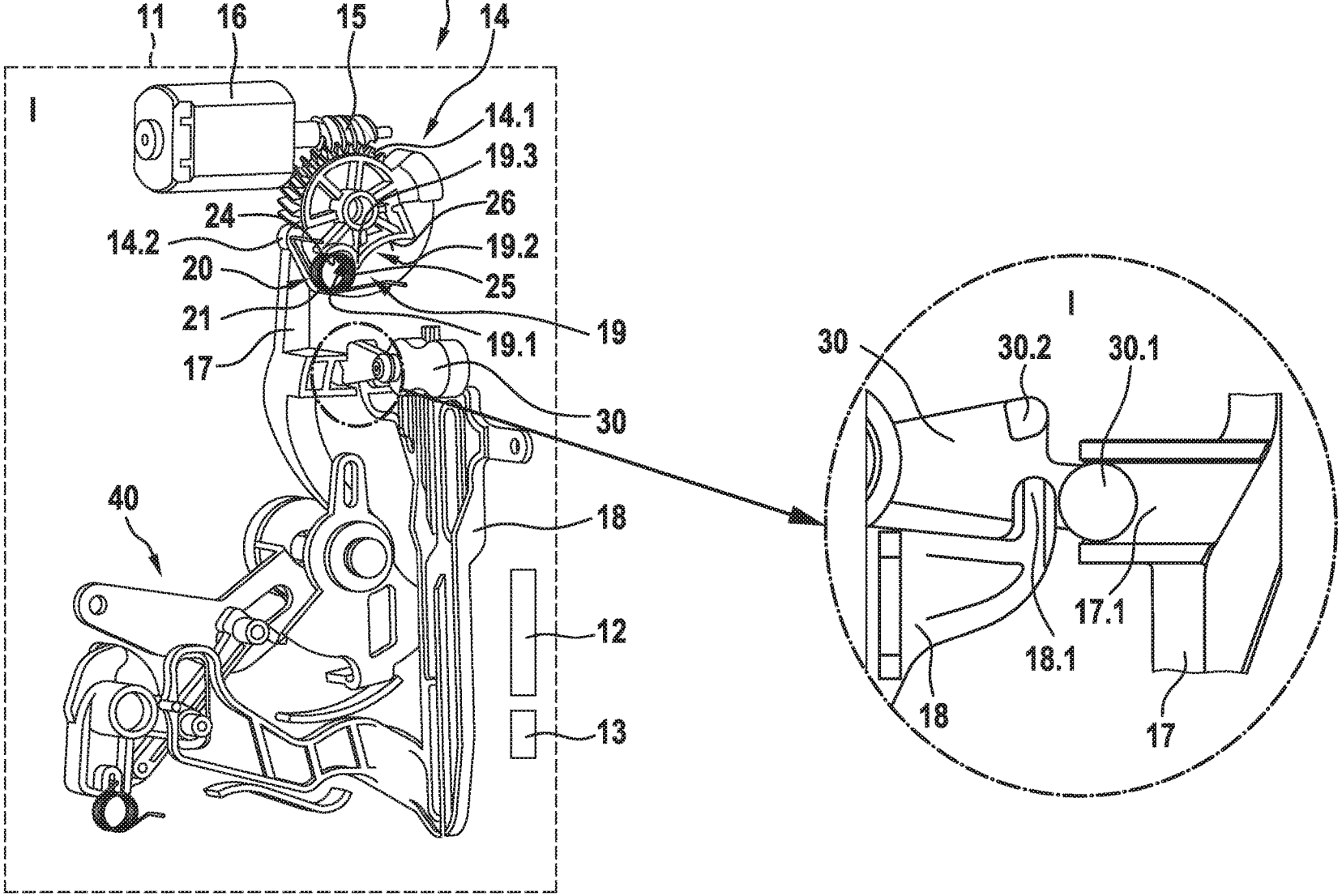
FIG. 1A shows a first possible embodiment of a motor vehicle latch according to the invention in a first position/functional position.

FIG. 1A shows a first possible embodiment of a motor vehicle latch 10 according to the invention. The motor vehicle latch 10 comprises a latch cover 11 and a locking mechanism, comprising a catch 12 and a pawl 13, as well as a drive comprising a drive element 14, a worm gear 15, and a motor 16. Furthermore, the motor vehicle latch 10 comprises a first coupling lever 17 and a second coupling lever in the form of an external locking lever 18, the coupling lever 17 and the external locking lever 18 being coupled by means of a transmission lever 30, and the external locking lever 18 being connected to a central locking mechanism 40. The coupling lever 17 is rotatably arranged on a bearing seat 14.2 of the drive element 14.

A spring mechanism 20 interacts with the drive element 14. For this purpose, in the embodiment shown the spring mechanism 20 is designed as a double torsion spring and comprises a coil portion 21 that is engaged in a first position receiving point 19.1 of a latching contour 19. In this case, the double torsion spring can be fastened for example to a latch cover 11 or a latch casing. The drive element 14 comprises a second position receiving point 19.2 on the latching contour 19, the second position receiving point 19.2 being asymmetrical. Both position receiving points 19.1 and 19.2 are substantially arcuate. The latching contour 19 is formed in the region of the axis of rotation 11.1 of the drive element 14 and, in FIG. 1A, comprises reinforcing ribs. In a position diametrically opposed to the latching contour 19, the drive element 14 comprises an external toothing portion 14.1 on the periphery, the external toothing portion 14.1 being engaged in the worm gear 15.

The tipping point 19.3 is formed between the position receiving points 19.1 and 19.2. The position receiving points 19.1, 19.2 and the tipping point 19.3 form the first, second and third position. In this case, the first position I on the position receiving point 19.1 is defined by the functional position "anti-theft lock engaged and central locking system engaged." A second position II on the position receiving point 19.3 (tipping point) can be defined by the functional position "anti-theft lock disengaged and central locking system engaged." A third position III on the position receiving point 19.2 can be defined by the functional position "anti-theft lock and central locking system disengaged." In the case of motor vehicle latches having an anti-theft function, the functional position or position "anti-theft lock" can also be designated "theft-proof," both the outside door handle and the inside door handle remaining in the functionless position in the theft-proof position. In this way, it is ensured that a motor vehicle door does not provide any access to the interior of the motor vehicle, even in the case of a smashed motor vehicle pane.

FIG. 1A shows the motor vehicle latch 10 in the first position I and thus in the functional position "anti-theft lock engaged and central locking system engaged." In this case, the coil portion 21 contacts the position receiving point 19.1 on two lay-on surfaces 24, 25. In this case, the lay-on surfaces 24, 25 are preferably straight, i.e. they do not have any arcuate curvature in the region of the lay-on surfaces 24, 25. The position receiving point 19.2 is designed so as to be asymmetrical compared with the first position receiving point 19.1 and comprises a contact surface 26 which can be brought into contact with the coil portion 21.

The drive element 14 is designed as a worm gear and comprises an external toothing portion 14.1 which is engaged with the electrical drive 15, 16. In particular, the external toothing portion 14.1 is engaged with a worm gear 15 of the electrical drive 15, 16. Accordingly, the drive element 14 is designed so as to have external toothing, and is arranged on the latch cover 11 or latch housing so as to be rotatable, via an axis of rotation 11.1. The drive element 14 designed as a worm gear 14 preferably comprises plastics material. The external toothing portion 14.1 and the latching contour 19, in particular the position indentations 19, 19.2, are preferably arranged on the drive element 14 so as to be diametrically opposed to the external toothing portion 14.1. The design as a worm gear having an external toothing portion 14.1 also makes it possible for installation space to be saved, and for a cost-effective motor vehicle latch 10 to be provided.

Furthermore, a detail view of FIG. 1A is shown, the connection of the coupling lever 17, the transmission lever 30 and the external locking lever 18 being shown in greater detail and as a rear view. The external locking lever 18 comprises an arm 18.1, the arm 18.1 being arranged, in position I, so as to be substantially in parallel with the ball head 30.1 and below a carrier 30.2 of the transmission lever 30. In this case, the ball head 30.1 of the transmission lever 30 is movably mounted in the lever receptacle 17.1.

Figure 1B:
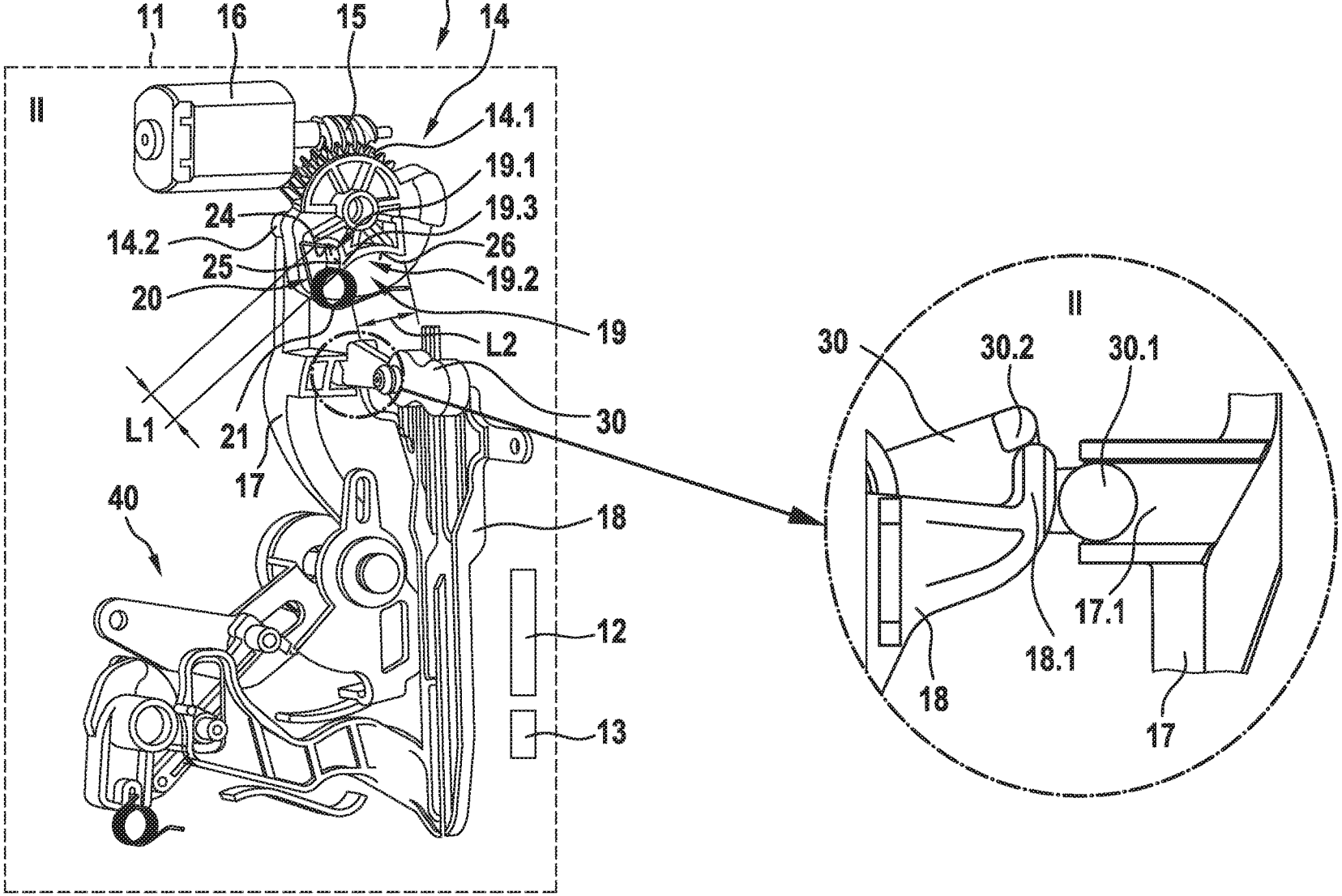
FIG. 1B shows the embodiment of FIG. 1A in a second position/functional position.

FIG. 1B shows the motor vehicle latch 10 of FIG. 1A in a second position II and thus in the functional position "anti-theft lock disengaged and central locking system engaged." In this case, the coil portion 21 of the spring mechanism 20 contacts the tipping point 19.2 of the latching contour 19. In FIG. 1B, the drive element 14 is rotated about the axis of rotation 11.1, in the clockwise direction. Accordingly, the coupling lever 17 connected to the drive element 14 is likewise moved therewith in the clockwise direction, and is thus raised compared with position I. The movement of the coupling lever 17 brings about a rotational movement of the transmission lever 30 which is rotatably arranged on a shaft, on the external locking lever 18.

The first position receiving point is of a length L1, and the at least second position receiving point is of a length L2, the length L2 of the second position receiving point being greater than the length L1 of the first position receiving point. A greater length also means an increase in the possible contact surface for contact between the position receiving point 19.1, 19.2 and the spring mechanism 20, and thus a longer travel range or increased lift for the coupling lever 17 and external locking lever 18. The length of the position receiving point 19.1, 19.2 thus also brings about a change or increase in the adjustment angle of the spring mechanism at the drive element 14. The adjustment angle of the spring mechanism 20 at the second position receiving point 19.2 is thus increased compared with the achievable adjustment angle of the first position receiving point 19.1.

Furthermore, a detail view of FIG. 1B is shown, the connection of the coupling lever 17, the transmission lever 30 and the external locking lever 18 being shown in greater detail and as a rear view. The external locking lever 18.1 comprises an arm 18.1, the arm 18.1 being in contact, in II, with a carrier 30.2 of the transmission lever 30.

Figure 1C:
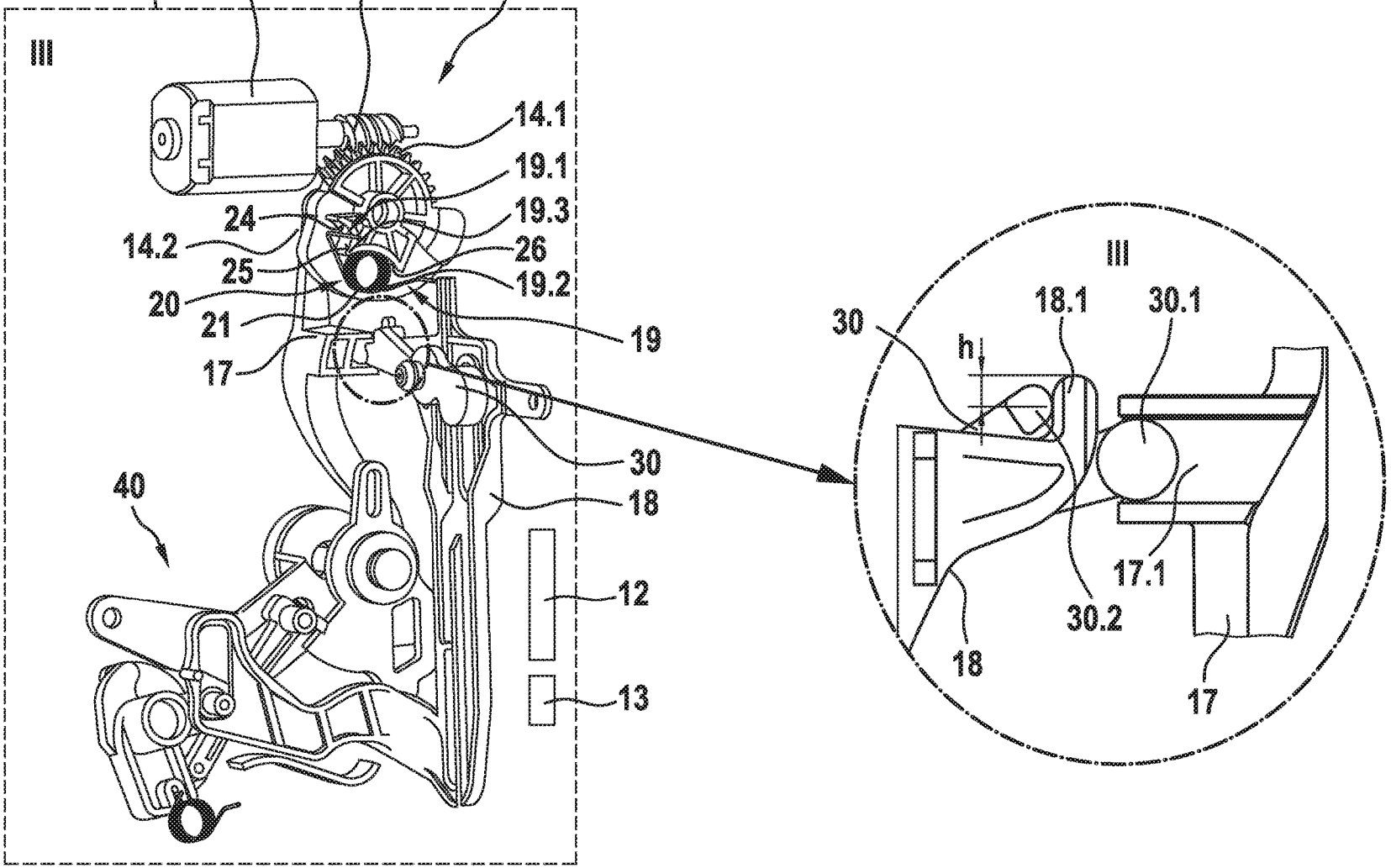
FIG. 1C shows the embodiment of FIG. 1A in a third position/functional position.

FIG. 1C shows the motor vehicle latch 10 of the first embodiment in position III and thus in the functional position "anti-theft lock and central locking system disengaged." The drive element 14 is arranged in a manner rotated further in the clockwise direction. The coil portion 21 of the spring mechanism 20 has overcome the tipping point 19.3, and now rests on the lay-on surface 26 of the second position receiving point 19.2.

Furthermore, a detail view of FIG. 1C is shown, the connection of the coupling lever 17, the transmission lever 30 and the external locking lever 18 being shown in greater detail and as a rear view. The external locking lever 18.1 comprises an arm 18.1, the arm 18.1 being in arranged, in position III, between the ball head 30.1 and a carrier 30.2 of the transmission lever 30, and being in contact therewith. Thus, in position III the arm 18.1 is moved past the carrier 30.2, at least in portions. In this case, the arm 18.1 is moved past the carrier 30.2, resulting in the increased lift h. The external locking lever can accordingly move beyond the contact shown in FIG. 1B, by the increased lift h. Only then is the motor vehicle latch in the position III in which the central locking system is also engaged, but only after the anti-theft lock has been disengaged in position II.

Figure 2A:
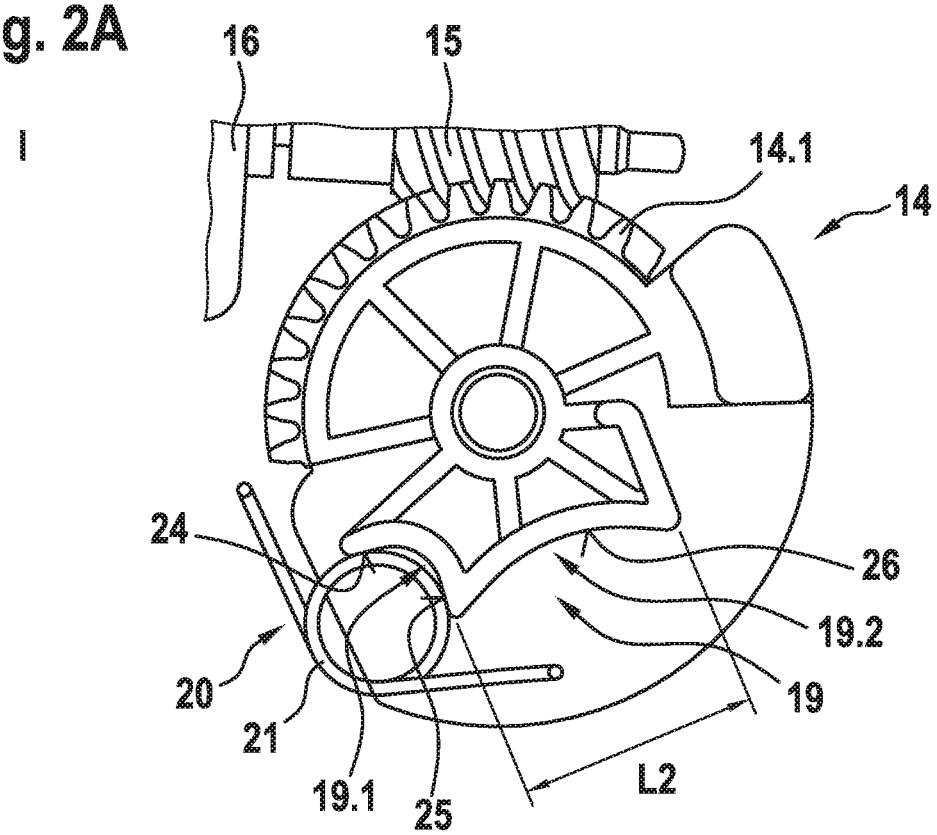
FIG. 2A is a detailed view of the drive in the first position/functional position.

FIG. 2A is a detail view of the drive 14, 15, 16 of a possible embodiment of a motor vehicle latch according to the invention, as is shown in FIGS. 1A, 1B and 1C. The drive element 14 is designed as a worm gear and comprises an external toothing portion 14.1, the external toothing portion 14.1 being engaged in the worm gear 15. The coil portion 21 of the double torsion spring 20 is engaged in the first position receiving point 19.1, such that position I is assumed. The coil portion 21 contacts the latching contour 19 on the lay-on surfaces 24 and 25, which lay-on surfaces are substantially straight. The position receiving point 19.2 is of a length L2 and is asymmetrical. In this case, asymmetrical means, inter alia, that the length L2 of the second position receiving point 19.2 is greater than the length of the first position receiving point 19.1 While, in the first position receiving point 19.1, the coil portion has exactly two contact points with the latching contour 19, the position receiving point 19.2 is dimensioned such that the coil portion has just one contact point and can slide along the contact surface 26. In the position receiving point 19.1, in contrast, the coil portion 21 is secured by the spring force so as to be substantially fixed in position but releasable.

Figure 2B:
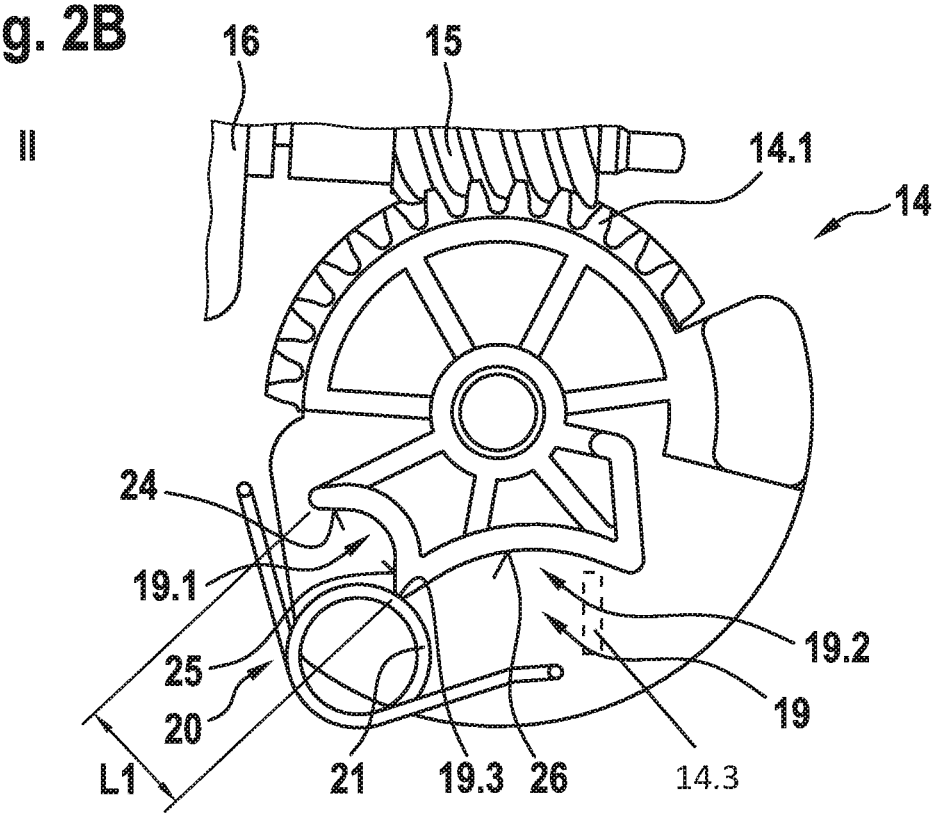
FIG. 2B is a detailed view of the drive in the second position/functional position.

In FIG. 2B, the drive element 14 is rotated in the clockwise direction, such that the coil portion 21 is arranged on the tipping point 19.3 and the position II is assumed. The coil portion 21 is thus released from the position receiving point 19.1, but not yet arranged in the position receiving point 19.2. The position receiving point 19.1 is shown having a length L1, the length L1 being shorter than the length L2 of the second position receiving point 19.2 and is thus asymmetrical. Furthermore, the end stop 14.3 is shown in FIG. 2B, it being possible for the end stop 14.3 to be brought into contact with a housing stop on the latch cover or a latch casing. The end stop 14.3 ensures in particular that the drive element 14 is not rotated further in the event of electrical/motorized displacement of the drive element 14. Accordingly, the end stop 14.3 comes into contact with the mating stop, and the drive element 14 cannot be twisted further in one direction. In this case, the end stop 14.3 is arranged on the latching contour 19 and thus the side of the drive element 14 remote from the position receiving points 19.1 and 19.2.

Figure 2C:
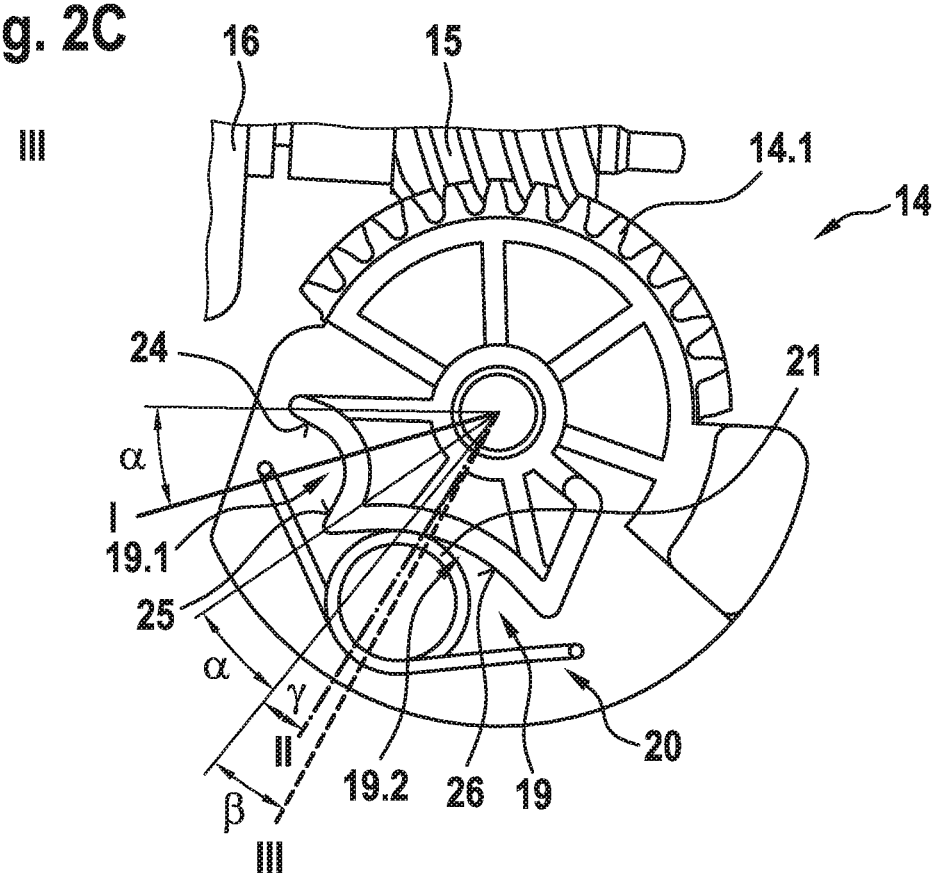
FIG. 2C is a detailed view of the drive in the third position/functional position.

FIG. 2C shows the position III, the drive element 14 being rotated further in the clockwise direction. In this case, the coil portion 21 is arranged in the position receiving point 19.2 in the region of the apex of the substantially arcuate position receiving point 19.2. Only upon reaching said position III, and the associated adjustment angle $\alpha+\beta$, is the functional position achieved in which the central locking system is also disengaged, but only after disengagement of the anti-theft lock. The position I has an adjustment angle $\alpha$. In this case, the adjustment angle defines the center point/apex of the position receiving point 19.1 The position II has an adjustment angle $\alpha+\gamma$. The portion between the tipping point 19.3 and the adjustment angle $\alpha+\gamma$ defines the position II. Thus, a travel range is achieved in which the position II is/can be engaged. The position III is reached only after the coil portion 21 has reached the angular position $\alpha+\gamma$ or the adjustment angle $\alpha+\beta$. The drive element 14 preferably reaches the adjustment angle $\alpha+\beta$ only by means of electrical/electromechanical operation. The adjustment angle $\beta$ thus defines the increased lift h of the external locking lever, as shown in FIG. 1C.

Only when the adjustment angle $\alpha+\gamma$ or $\alpha+\beta$ is reached, is the central locking system disengaged. In the angular region $\alpha$ between the tipping point 19.3 as far as the angular position $\alpha+\gamma$, the child safety lock and/or an anti-theft lock is disengaged. It is thus possible to ensure that the central locking system is not disengaged before the anti-theft lock. It is thus possible to prevent an occupant from being locked in unintentionally.

Figure 3:
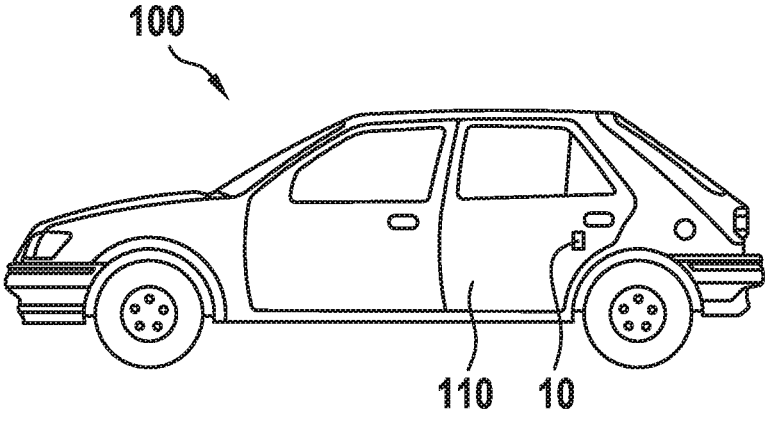
FIG. 3 shows a motor vehicle comprising a motor vehicle latch according to the invention.

FIG. 3 shows a motor vehicle 100 comprising a motor vehicle latch 10 according to the invention on a movable part 110 of the motor vehicle 100. In FIG. 3, the movable part 110 is shown as a rear door of the motor vehicle 100, such that the motor vehicle latch 10 is designed as a motor vehicle latch of a vehicle rear door.

LIST OF REFERENCE SIGNS

10 motor vehicle latch
11 latch cover
11.1 axis of rotation
12 catch
13 pawl
14 drive element
14.1 external toothing portion

14.2 bearing seat
14.3 end stop
15 worm gear
16 motor
17 coupling lever
17.1 lever receptacle
18 external locking lever
18.1 arm
19 latching contour
19.1 first position receiving point
19.2 second position receiving point
19.3 tipping point
20 spring mechanism
21 coil portion
24 lay-on surface
25 lay-on surface
26 contact surface
30 transmission lever
30.1 ball head
30.2 carrier
40 central locking mechanism
100 vehicle
110 rear door
I first position
II second position
III third position
h increased lift
L1 length of first position receiving point
L2 length of second position receiving point

The invention claimed is:

1. A motor vehicle latch for a motor vehicle rear door, the motor vehicle latch comprising:

a latch cover;

a locking mechanism having a catch and at least one pawl;

at least one coupling lever;

at least one electrical drive having a drive element, the at least one coupling lever assuming various positions and interacting with the drive element and a central locking mechanism, the at least one coupling lever being connected to the drive element to assume the various positions, wherein the drive element has a latching contour having at least two position receiving points, at least one of the at least two position receiving points being asymmetrical, and a spring mechanism that cooperates with the latching contour whereby the at least one coupling lever is configured to be positioned in the various positions, wherein, in a first position receiving point of the at least two position receiving points, the spring mechanism has a contact point on a lay-on surface, and wherein in a second position receiving point of the at least two position receiving points, the spring mechanism has a contact point having a contact surface.

2. The motor vehicle latch according to claim 1, wherein at least a second position receiving point of the at least two position receiving points has a geometry that differs from a first position receiving point of the at least two position receiving points.

3. The motor vehicle latch according to claim 2, wherein the various positions include a first position having a first adjustment angle, a second position having a second adjustment angle, and a third position having a third adjustment angle, wherein the second adjustment angle of the second position and/or the third adjustment angle of the third position are larger than the first adjustment angle of the first position.

4. The motor vehicle latch according to claim 3, wherein the second adjustment angle of the second position is formed in a region between a tipping point and an apex of the second position receiving point.

5. The motor vehicle latch according to claim 4, wherein the first position is arranged inside the first position receiving point, and the third position is arranged inside the second position receiving point, the tipping point being formed between the first position receiving point and the second position receiving point.

6. The motor vehicle latch according to claim 4, wherein the tipping point form a highest point between the apex of the second position receiving point and another apex of the first position receiving point.

7. The motor vehicle latch according to claim 3, wherein the first position receiving point is of a first length, and at least the second position receiving point is of a second length, the second length of the second position receiving point being greater than the first length of the first position receiving point.

8. The motor vehicle latch according to claim 1, wherein the at least two position receiving points are formed to be semi-circular and/or V-shaped.

9. The motor vehicle latch according to claim 1, wherein the spring mechanism is a torsion spring, wherein a coil portion of the spring mechanism is configured to contact at least with lay-on surface of the at least two position receiving points.

10. The motor vehicle latch according to claim 9, wherein a length of a first position receiving point of the at least two position receiving points is smaller than a diameter of the coil portion.

11. The motor vehicle latch according to claim 9, wherein the torsion spring is a double torsion spring.

12. The motor vehicle latch according to claim 1, wherein the spring mechanism is arranged on the latch cover or on the coupling lever.

13. The motor vehicle latch according to claim 1, wherein the spring mechanism comprises at least two fastening ends.

14. The motor vehicle latch according to claim 1, wherein the drive element is a worm gear and comprises an external toothing portion which is engageable with the electrical drive.

15. The motor vehicle latch according to claim 1, wherein the at least one coupling lever is rotatably mounted on a bearing seat on the drive element, and is operatively connected to an external locking lever by a transmission lever.

16. The motor vehicle latch according to claim 1, wherein the drive element comprises a mechanical end stop, wherein the mechanical end stop is configured for contact with a housing stop on the latch cover or a latch casing.

17. The motor vehicle latch according to claim 1, wherein the at least one coupling lever is arranged on the drive element, wherein the drive element is rotatable about an axis of rotation.

18. The motor vehicle latch according to claim 1, wherein the at least two position receiving points are formed as concave receptacles in the latching contour that enable the spring mechanism to slide into the at least two position receiving points.

19. A motor vehicle latch for a motor vehicle rear door, the motor vehicle latch comprising:

a latch cover;

a locking mechanism having a catch and at least one pawl;

at least one coupling lever;

at least one electrical drive having a drive element, the at least one coupling lever assuming various positions and interacting with the drive element and a central locking mechanism, the at least one coupling lever being connected to the drive element to assume the various positions, wherein the drive element has a latching contour having at least two position receiving points, at least one of the at least two position receiving points being asymmetrical, and a spring mechanism that cooperates with the latching contour whereby the at least one coupling lever is configured to be positioned in the various positions, wherein the at least one coupling lever is rotatably mounted on a bearing seat on the drive element, and is operatively connected to an external locking lever by a transmission lever.

20. A motor vehicle latch for a motor vehicle rear door, the motor vehicle latch comprising:

a latch cover;

a locking mechanism having a catch and at least one pawl;

at least one coupling lever;

at least one electrical drive having a drive element, the at least one coupling lever assuming various positions and interacting with the drive element and a central locking mechanism, the at least one coupling lever being connected to the drive element to assume the various positions, wherein the drive element has a latching contour having at least two position receiving points, at least one of the at least two position receiving points being asymmetrical, and a spring mechanism that cooperates with the latching contour whereby the at least one coupling lever is configured to be positioned in the various positions, wherein the at least two position receiving points are formed as concave receptacles in the latching contour that enable the spring mechanism to slide into the at least two position receiving points.

* * * * *